US005138809A

United States Patent [19]

Saikachi

[11] Patent Number: 5,138,809

[45] Date of Patent: Aug. 18, 1992

[54] JOINT STRUCTURE FOR FIXING PANEL BLOCKS ON SIDE WALL OF BUILDING

[76] Inventor: Akira Saikachi, 6368, Ichinocho, Ikarashi, Niigata-shi, Niigata-ken, Japan

[21] Appl. No.: 580,884

[22] Filed: Sep. 11, 1990

[30] Foreign Application Priority Data

Mar. 29, 1990 [JP] Japan ..... 2-33442
Jul. 3, 1990 [JP] Japan ..... 2-71430

[51] Int. Cl.[5] ..... E04B 1/38

[52] U.S. Cl. ..... 52/235; 52/508; 52/512; 52/513; 52/713

[58] Field of Search ..... 52/235, 713, 385, 386, 52/387, 714, 712, 283, 513, 508, 698, 512

[56] References Cited

U.S. PATENT DOCUMENTS

| | | | |
|---|---|---|---|
| 2,130,531 | 9/1938 | Arand | 52/714 |
| 3,353,312 | 11/1967 | Storch | 52/508 |
| 3,715,850 | 2/1973 | Chambers | 52/235 |
| 4,021,989 | 5/1977 | Hala | 52/713 |
| 4,060,951 | 12/1977 | Gere | 52/713 |
| 4,553,366 | 11/1985 | Guerin | 52/508 |
| 4,570,401 | 2/1986 | Uebel et al. | 52/235 |
| 4,720,952 | 1/1988 | Fricker | 52/508 |
| 4,744,191 | 5/1988 | Fricker | 52/235 |
| 4,922,679 | 5/1990 | Fricker | 52/698 |

*Primary Examiner*—Michael Safavi
*Attorney, Agent, or Firm*—Quarles & Brady

[57] ABSTRACT

A joint structure for fixing panel blocks on a side wall of a building in a manner such that the lower edge face of each panel block contacts closely with the upper edge face of the lower adjacent panel block to leave no gaps between the adjacent panel blocks. Each panel block is formed with a first blind bore extending vertically from the lower edge face thereof and a second blind bore extending vertically from the upper edge face thereof. The joint structure comprises first stud means anchored to the side wall of the building and having an exposed end extending beyond the exterior surface of the side wall of the building, second stud means anchored to each panel block and having an exposed end extending beyond the interior surface of each panel block, a positioning rod having one end inserted into the first blind bore of upper adjacent panel block and the other end inserted into the second blind bore of lower adjacent panel block, the positioning rod being pressed by the inner end of the second stud means to be fixedly held in position, and connector means having one end connected to the exposed end of the first stud means and the other end connected to the exposed end of the second stud means.

1 Claim, 4 Drawing Sheets

JOINT STRUCTURE FOR FIXING PANEL BLOCKS ON SIDE WALL OF BUILDING

BACKGROUND OF THE INVENTION

1. Filed of the Invention

The present invention relates to a joint structure for fixing plural panel blocks on an exterior or interior wall of a building.

2. Prior Art Statement

In order to improve the appearance of a building, it is a common practice to apply decoration panel blocks made of, for example, marble or natural stone on a wall of a building. Such decoration panel blocks must be securely fixed to the wall of the building not to fall down from the wall. Unexamined Japanese Utility Model Publication No. 73430/1988 discloses an example of a joint structure for fixing panel blocks, wherein an L-shaped metal has its vertical leg buried in the side wall of a building and its horizontal leg extending beyond the surface of the wall. A connector member is attached to the horizontal leg of the L-shaped metal and an edge end face of a panel block contacts at least with one side of the horizontal leg. Each panel block has a bore extending vertically from the edge end face, and a connection screw is inserted through a threaded hole provided through the connector member to extend into the bore of the panel block, the connection screw having a head, a threaded portion vicinal to the head and a pin portion provided in front of the threaded portion. The gap between the bore of the panel block and the connection screw is filled with an adhesive so that the connection screw is fixed into the bore of the panel block.

However, when plural panel blocks are piled one after another by the technology taught by the prior art referred to hereinabove, gaps are left between the adjacent panel blocks due to the thickness of the horizontal leg of the L-shaped metal. Such gaps must be sealed by filling mortar or like filler in the gaps, leading to deterioration of the appearance of the finished structure. The prior art technology has another disadvantage that it requires skillful operation.

OBJECTS AND SUMMARY OF THE INVENTION

An object of this invention is to provide a joint structure for fixing panel blocks on a wall of a building in such a manner that the lower edge face of each panel block contacts closely with the upper edge face of the lower adjacent panel block not to leave gaps therebetween.

Another object of this invention is to provide such a joint structure which can be handled with ease.

With the aforementioned objects in view, the present invention provides a joint structure for fixing panel blocks on a side wall of a building in a manner such that the lower edge face of each panel block contacts closely with the upper edge face of the lower adjacent panel block, each panel block having a first blind bore extending vertically from the lower edge face thereof and a second blind bore extending vertically from the upper edge face thereof, said joint structure comprising first stud means anchored to said side wall of said building and having an exposed end extending beyond the surface of said side wall of said building, second stud means anchored to each panel block and having an exposed end extending beyond the interior surface of each panel block, a positioning rod having one end inserted into said first blind bore of upper adjacent panel block and the other end inserted into said second blind bore of lower adjacent panel block, said positioning rod being pressed by the inner end of said second stud means to be fixedly held in position, and connector means having one end connected to said exposed end of said first stud means and the other end connected to said exposed end of said second stud means.

Since the positioning rod is fixedly pressed to the panel block by the action of the second stud means and the other end of the connector means contacts with the interior surface of the panel block, no gap is left between the edge end faces of adjacent panel blocks In a preferred embodiment, the second stud means comprises a cylindrical anchor member having a threaded center bore and a slitted end and a male screw member inserted into said threaded center bore of said cylindrical anchor member, whereby the anchor member can be fitted to the panel block under pressure to be securely fitted. In a further preferred embodiment, the second stud means comprises an anchor member having a ring-shaped cross section to be received in a ring-shaped anchor bore formed in each panel block. In a further modified embodiment, the second stud means comprises an anchor member having an end of generally flat disk shape to be received in a concaved slot of said panel block extending generally in the horizontal direction.

DESCRIPTION OF APPENDED DRAWINGS

The above and other objects and advantages of this invention will become apparent from the following detailed description of presently preferred embodiments thereof with reference to the appended drawings in which.

DESCRIPTION OF PREFERRED EMBODIMENTS

Figure 1:
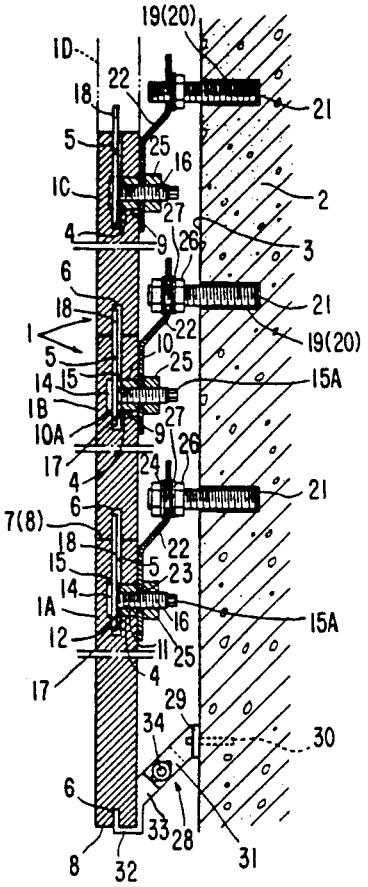
FIG. 1 is a sectional view showing a first embodiment of the invention.
Figure 2:
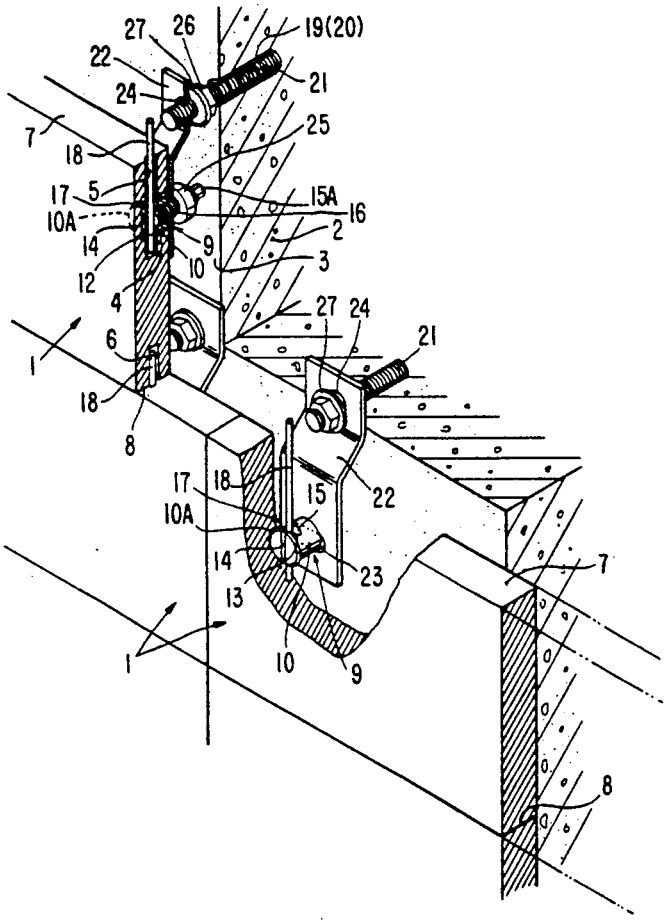
FIG. 2 is a perspective view of the first embodiment with parts cut away for easy understanding.
Figure 3:
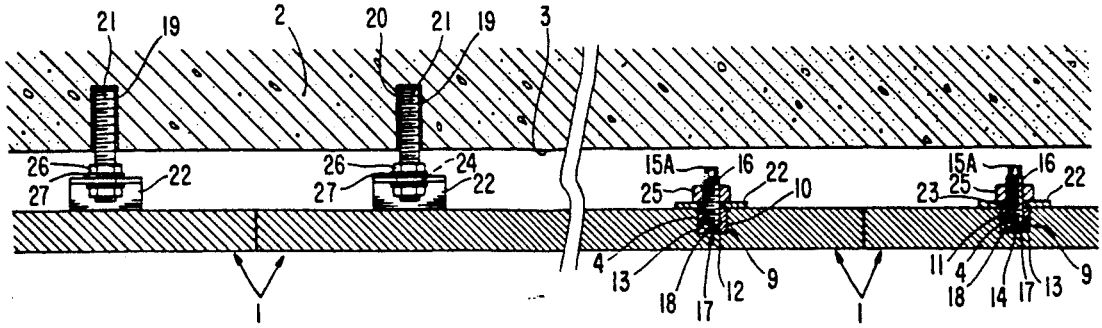
FIG. 3 is a sectional view of the first embodiment.
Figure 4:
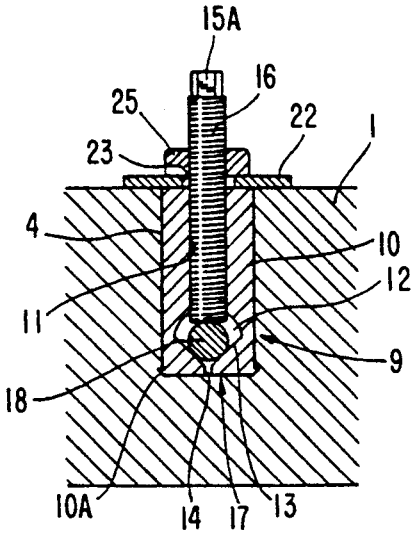
FIG. 4 is a sectional view showing the details of the second stud means of the first embodiment.
Figure 5:
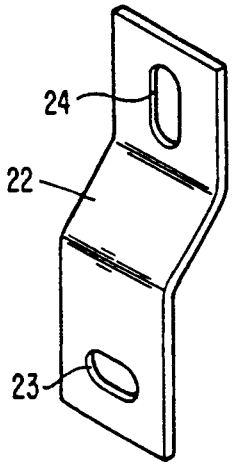
FIG. 5 is a perspective view of the connector means used in the first embodiment.

Initially referring to FIGS. 1 to 6, a first embodiment of this invention will be described.

Plural panel blocks 1 made of, for example, marble or natural stone are piled one after another to cover a outer side wall 3 of a concrete building 2.

Each panel block 1 is formed with a bore 4 extending from the interior surface at the upper portion thereof.

Each panel block also provided with a first blind bore 6 extending vertically from the lower edge face 8 and a second blind bore 5 extending vertically from the upper edge face 7. The first blind bore 6 of an upper adjacent panel block and the second blind bore 5 of a lower adjacent panel block are agreed with each other to form a substantially straight and continuous bore when these blocks are piled one on the another.

An anchor member 9 is inserted into the bore 4, and has a generally cylindrical body 10 having a center bore formed with an internal thread 11. The end of the thread is enlarged to form an enlarged cavity 12. As best seen from FIG. 3, the inner half of the enlarged cavity 12 is defined by symmetrical tapered walls 13 which are converged with each other. A slitted hole 14 is formed at the fore end of the cylindrical body 10 so that the fore end of the anchor member 9 is bifurcated. A vertical through-hole 15 is formed at a portion of the enlarged cavity 12 so that this vertical hole 15 extends coaxially with the second blind bore 5.

A male screw member 16 is threaded into the internal thread 11 of the anchor member 9, and a square projection 15A is formed on the exposed end of the male screw member 16 for engaging with a tool (not shown). A first stud means 17 is formed by the combination of the male screw member 16 and the anchor member 9. By thrusting the male screw member 16 into the internal thread 11, a positioning rod 18 inserted into the first and second vertical blind bores 6 and 5 is pressed onto the tapered walls 13 to be fixed in position, and simultaneously the slit 14 is enlarged outwardly so that the fore end of the anchor member 9 is compressed onto the inner wall of the bore 4 to be prevented from slipping out of the bore 4. Another anchor member 19 is anchored to the wall 3 of the building 2. The anchor member 19 is provided with an internal thread 20, and a male screw member 21 is threaded into the internal thread 20 to serve as the first stud means. Connector means 22 has one end connected to the male screw member 21 and has the other end connected to the male screw member 16. The upper plate portion of the connector means 22 is provided with an elongated hole 23 and the lower plate portion of the connector means 22 is also provided with an elongated hole 24, so that both ends cf the connector means 22 can be connected to the male screw members 16 and 19 while adjusting its position along the horizontal and vertical directions relative to the male screw members 16 and 19. Reference numerals 25 and 26 designate nuts which are meshed with the male screw members 16 and 21, and reference numeral 27 designates a washer.

Figure 6:
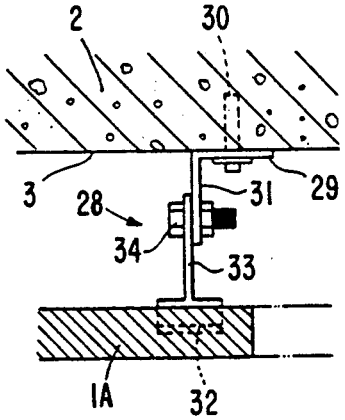
FIG. 6 is a sectional view showing the joint structure for fixing the lowermost panel block in the first embodiment.

The lowermost panel block 1A is supported by a support assembly 28 which comprises a first support member 31 having an L-shaped section and a second support member 32 having a bent projection at one end thereof. As shown in FIG. 6, one leg of the first support member 31 is engaged with the surface of the wall 3 of the building 2 and fixed in position by means of an anchor bolt 30. The bent projection of the second support member 32 is inserted in the first blind bore 6 of the lowermost panel block 1A, and the other end of the second support member 32 is joined with the other leg of the first support member 31 by means of a bolt and nut pair 34 inserted through a hole 33. The connector means 22 and the anchor members 9 and 19 may be made of a metal, such as stainless steel.

The assembling operation of the aforementioned joint structure will now be described in detail.

Initially, bores 4 are formed by drilling at proper positions of the concrete wall 3 of the building 2, and an anchor member 19 is anchored into each bore 4 and a male screw member 21 is thrusted into each anchor member 19. Vertically extending bores 5 and 6 are pierced from the upper and lower edge faces of each of the panel blocks 1B, 1C, and a bore 4 is formed at a proper position of the interior surface of each panel block 1. One anchor member 9 is inserted into each bore 4 to be fixedly anchored to the interior surface of each panel block 1, and a positioning rod 18 is inserted into the second or upper blind bore 5 to extend through the vertical through-hole 15 of the anchor member 9. The square projection 15A of the male screw member 16 is grasped by a wrench or like proper tool to rotate the member 16 to thrust the male screw member 16 into the internal thread 11, whereby the positioning rod 18 is pressed onto the tapered walls 13 so that the positioning rod 18 is fixed in position and simultaneously the slit 14 is pushed outwardly to prevent the anchor member 9 from slipping out of the bore 4. The male screw member 16 is then inserted through the elongated hole 23 of the connector means 22 and fixed by the nut 25.

The support assembly 28 is secured on the wall 3, and then the bent projection of the second support member 32 is inserted into the lower or first vertical blind bore 6 to support the lowermost panel block 1A in position. The male screw member 21 is inserted through the elongated hole 24 of the connector means 22 and fixed by the nut 26 and the washer 27, whereby the lowermost panel block 1A is suspended by the wall 3 of the building 2 through the support assembly 28 and the connector means 22. Thereafter, a second panel block 1B is placed on the lowermost panel block 1A while the upper edge face 7 of the latter is faced to the lower edge face 8 of the former. In this step, the upper end of the positioning rod 18 projecting beyond the upper edge face 7 of the lowermost panel block 1A is inserted into the lower or first blind bore 6 of the second panel block 1B so that the exterior side faces of both panel blocks flush with each other to form a flat and smooth joined surface. Although not shown in the drawings, an filler, such as mortar or an adhesive, may be filled in the upper blind bore 5 of the lowermost panel block 1A and the lower blind bore 6 of the second panel block 1B, or an adhesive may be applied over the edge faces 7 and 8 to bind the adjacent panels 1A and 1B more firmly. Then the male screw member 21 is inserted through the elongated hole 24 of the connector means 22 for connecting the second panel block 1B, followed by tightening the nut 26 by means of a wrench (not shown) to fix the second panel block 1B in position.

The aforementioned operation sequence is repeated to pile and fix third, fourth,—panel blocks 1C, 1D.

As will be understood from the forgoing, since each panel block 1 is suspended by the wall 3 through the connector means 22 while the lower leg of the connector means 22 contacts with the interior side face of the panel block 1, no gap is left between the adjacent panel blocks and the piled panel blocks 1 form a continuous exterior surface to improve the appearance of the finished structure.

In addition, the positioning rod 18 is pressed onto the tapered walls 13 formed in the end portion of the anchor member 9 and fixed in position by tightening the male screw member 16, the piled panel blocks 1A, 1B,—can be firstly assembled without the fear of tottering or other unstable condition.

Each panel block 1 can be fixed in position by the operation sequence including the steps of inserting the male screw member 21 into the anchor member 19 followed by tightening the member 19, inserting the male screw member 16 into the anchor member 9 followed by tightening the member 16 to fix the positioning rod 18, fixedly connecting the lower leg of the connector means 22 to the exposed end of the male screw member 16, connecting the upper leg of the connector means 22 to the exposed end of the male screw member 21 to suspend each panel block 1, and then tightening the nut 22. This operation sequence does not require skillful work.

Figure 7:
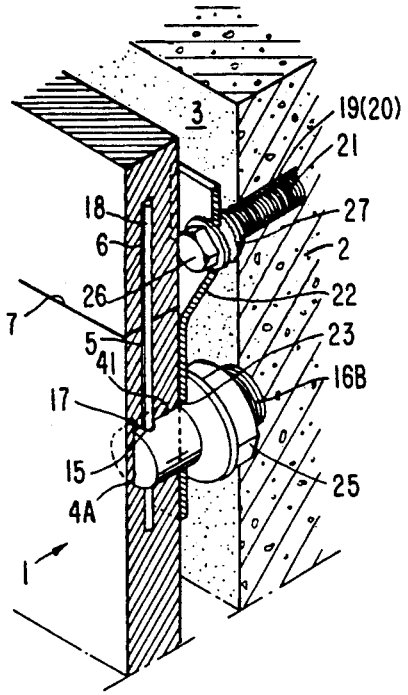
FIG. 7 is a perspective view of a second embodiment with portions cut away for easy understanding.
Figure 8:
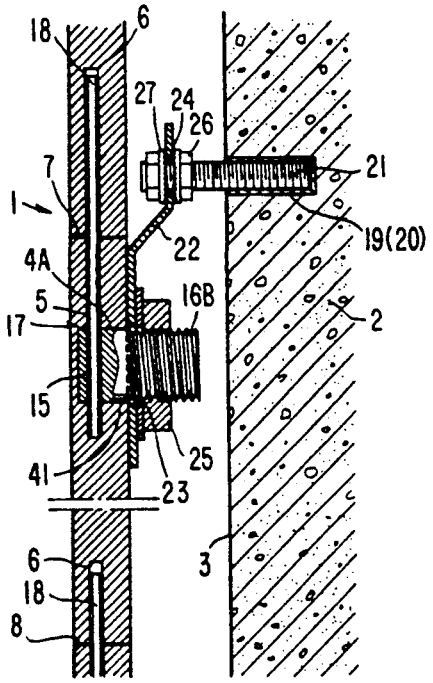
FIG. 8 is a sectional view of the second embodiment.
Figure 9:
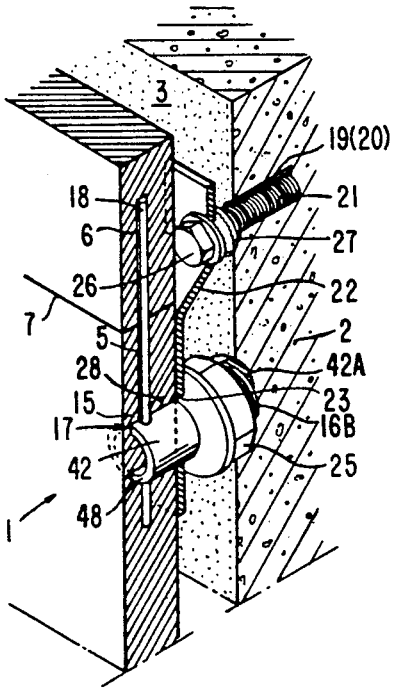
FIG. 9 is a perspective view of a third embodiment with portions cut away for easy understanding.
Figure 10:
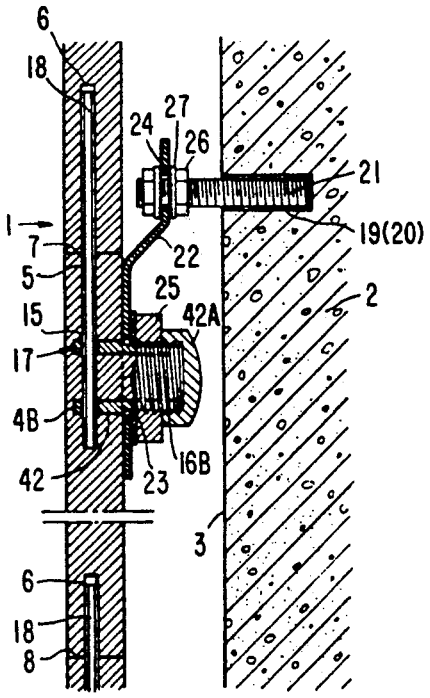
FIG. 10 is a sectional view of the third embodiment.
Figure 11:
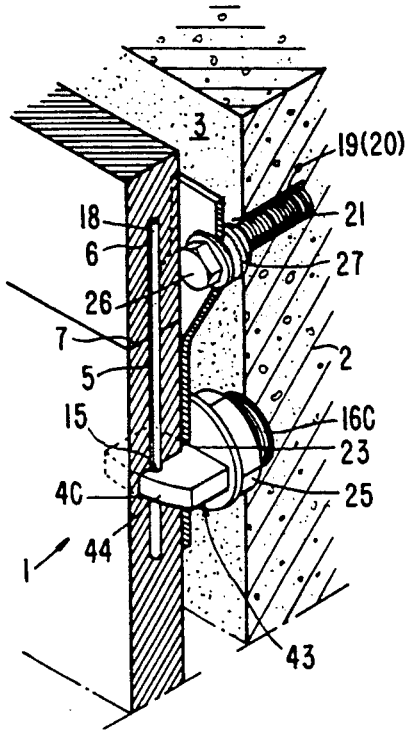
FIG. 11 is a perspective view of a fourth embodiment with portions cut away for easy understanding.
Figure 12:
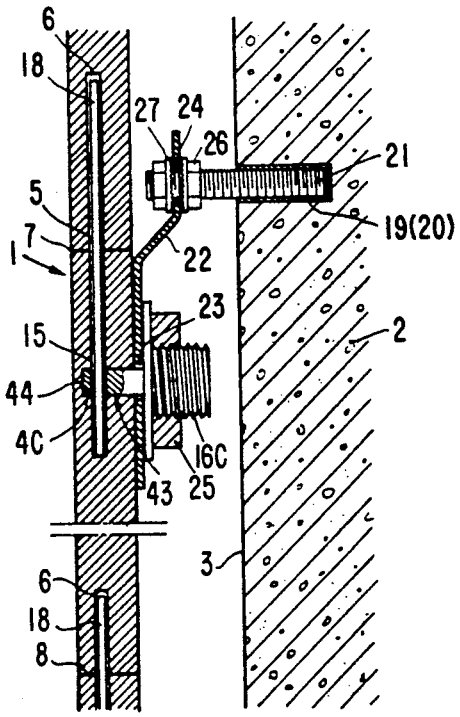
FIG. 12 is a sectional view of the fourth embodiment.

A second embodiment of this invention is shown in FIGS. 7 and 8; a third embodiment is shown in FIGS. 9 and 10; and a fourth embodiment is shown in FIGS. 11 and 12. In these modified embodiments, the same parts are denoted by the same reference numerals and the description thereof will not be given for simplicity of the description.

Now referring to FIGS. 7 and 8 showing the second embodiment of the invention, the stud means anchored to each panel block 1 comprises a generally cylindrical member 41 having an end portion through which a vertical through-hole 15 is formed, and a male screw member 16 having one end protruding beyond the interior surface of the panel block 1.

The cylindrical member 41 is fixedly anchored in a bore 4A with the vertical through-hole 15 extends coaxially with the upper and lower blind bores 5 and 6 extending respectively from the upper and lower edge faces of the panel block 1. After inserting a positioning rod 18 into the upper blind bore 5 to extend through the vertical through-hole 15, a male screw member 16 is inserted through the elongated hole 23 of the connector means 22 and screw-fitted with the member 16, and then the nut 25 is tightened to fix the connector means 22 in position. As the connector means 22 is fixed by tightening the nut 25, the cylindrical member 41 is drawn through the male screw member 16A toward the building 2 so that the positioning rod 18 is pressed to the wall of the lower blind bore 6 to prevent from slipping out of the bore 6 to ensure firm connection. The lower leg of the connector means 22 is fixedly connected to each panel block 1 by tightening the male screw member 16.

The operation efficiency can be improved by the use of the second embodiment as will be seen from the foregoing. In the second embodiment, a generally cylindrical member 41 is anchored into the bore 4A formed at a proper position on each panel block 1, the vertical through-hole 15 being formed through the end portion of the cylindrical member 41 to allow the positioning rod 18 to extend therethrough, and the male screw member 16 is screwed into the cylindrical member 41 and has the exposed end to which the connector means 22 is connected and fixed by means of the nut 25, the positioning rod 18 being fixed in position by the cylindrical member 41.

In the third embodiment shown in FIGS. 9 and 10, each panel block 1 is formed with a ring-shaped anchor bore 4B and an upper blind bore 5 extends from the upper edge face in the vertical direction. An anchor member 42 has an anchored end having a ring-shaped section, through-holes 15 being formed through the peripheral wall of the ring-shaped section to extend coaxially with the upper blind bore 6, and a male screw end 16B extending beyond the interior surface of the panel block 1. Reference numeral 42A designates a rubber cap.

The anchor member 42 is anchored to the ring-shaped anchor bore 4B and a positioning rod 18 is inserted through the upper blind bore 5 to extend through the through-holes 15, 15 formed through the peripheral wall of the ring-shaped section of the anchor member 42. Then, the male screw end 16B is inserted through the elongated hole 23 of the connector means 22, and then the nut 25 is fitted on the male screw end 16B and tightened. As the connector means 22 is connected to each panel block 1, the anchor member 42 is drawn toward the building 2 through the nut 25 and the male screw end 16B, whereby the positioning rod 18 is pressed onto the wall of the lower blind bore 6 so that the anchor member 42 is prevented from slipping out of the bore 4B to be firmly fixed in position. The lower leg of the connector means 22 is fixed by means of the male screw end 16B so that each panel block 1 can be firmly fixed in position.

According to the third embodiment of the invention, the operation efficiency is improved and steady fixation is ensured by the combination of the anchor bore 4B having a ring-shaped section and the anchor member 42 having the anchored end of ring-shaped contour.

The ring-shaped anchor bore 4B may be formed by using a ring-shaped drill. The volume of the panel material which must be removed for excavating the anchor bore 4B is decreased, as compared to the preceding embodiments where a cylindrical cavity must be excavated, to simplify the operation and to decrease the time required for forming the anchor bore 4B.

In the fourth embodiment shown in FIGS. 11 and 12, an anchor bore 4C formed in each panel block 1 has a shape of generally flat concave or slot. An stud member 43 anchored into this anchor bore 4C has a flat disk-shaped end 44 to be received into the anchor bore 4C and a male screw end 16C protruding beyond the interior surface of the panel block 1. A through-hole 15 is formed through the disk-shaped end for allowing a positioning rod 18 to extend therethrough.

The disk-shaped end of the stud member 43 is inserted into the anchor bore 4C formed in each panel block 1, and the positioning rod 18 is inserted into the upper blind bore 5 to extend through the through-hole 15. The male screw end 16C of the stud member 43 is inserted through an elongated hole 23 of connector means 22 and then a nut 25 is screw-fitted on the male screw end 16C. As the connector means 22 is fixedly connected, by tightening the nut 25, to the panel block 1, the stud member 43 is drawn toward the building 2 so that the positioning rod 18 is pressed onto the wall of the lower blind bore 6 to prevent the stud member 43 from stripping out of the bore 4C. The stud member 43 is thus firmly fixed and the panel block 1 is held in position by fixedly connecting the lower leg of the connector means 22 to the male screw end 16C.

The operation for fixing each panel block 1 is simplified according to the fourth embodiment. In addition, the anchor bore 4C having the flat disk-shaped end may be simply formed by cutting the side face of the panel block 1 by using a circular saw.

Although the present invention has been described with reference to preferred embodiments thereof, it should not be limited only to the illustrated embodiments. Many modifications and alternations may be made within the scope of the invention. For example, the wall of the building may be a partition wall, a reinforced concrete pillar, an iron framework or a wooden pillar. The panel block may be made of glass, tile, artificial stone, cement block or china panel. The present invention may be applied to cover an exterior or interior wall of a building. In place of the male screw member used in the illustrated embodiments, a hook member fixed by an adhesive may be used. The male screw member used in the stud means may be replaced by a wedge. Although the end of the anchored member is bifarcated by the provision of a slit, other approaches for enabling enlargement of the end of the anchored member may be easily conceived by a person having ordinary skill in the art without departing from the spirit of the invention.

It is preferable but not limited to use a rigid material, such as steel, for fabricating the stud means, the positioning rod, the male screw members, the connector means, and the cylindrical anchor member.

What is claimed is:

1. A joint structure for fixing panel blocks on a side wall of a building in a manner such that the lower edge face of the lower adjacent panel block, each panel block having a first blind bore extending vertically from the lower edge face thereof and a second blind bore extending vertically from the upper edge face thereof, said joint structure comprising first stud means anchored to said side wall of said building and having an exposed and extending beyond the exterior surface of said side wall of said building, second stud means anchored to each panel block and having an exposed end extending beyond the interior surface of each panel block, a positioning rod having one end inserted into said first blind bore of upper adjacent panel block and the other end inserted into said second blind bore of lower adjacent panel block, said positioning rod being pressed by the inner end of said second stud means to be fixedly held in position, and connector means having one end connected to said exposed end of said first stud means and the other end connected to said exposed end of said second stud means wherein said second stud means comprises a cylindrical anchor member having a threaded bore extending in the axial direction and a slitted end, and a male screw member inserted into said threaded bore of said cylindrical anchor member.

* * * * *

UNITED STATES PATENT AND TRADEMARK OFFICE

CERTIFICATE OF CORRECTION

PATENT NO. : 5,138,809

DATED : August 18, 1992

INVENTOR(S) : Akira Saikachi

It is certified that error appears in the above-identified patent and that said Letters Patent is hereby corrected as shown below:

Column 7, line 22, after "of" insert --each panel block contacts closely with the upper edge face of--.

Signed and Sealed this

Twelfth Day of October, 1993

*Attest:*

*Attesting Officer*

BRUCE LEHMAN

*Commissioner of Patents and Trademarks*